US008186270B2

(12) United States Patent
Kochar et al.

(10) Patent No.: US 8,186,270 B2
(45) Date of Patent: May 29, 2012

(54) TAMPON PAD PRINTING SYSTEM AND METHOD OF OPERATING

(75) Inventors: Arun Kochar, Jawa Barat (ID); Tony Solis, Halifax (CA); Mukund Dange, Maharashtra State (IN)

(73) Assignee: Mattel, Inc., El Segundo, CA (US)

( * ) Notice: Subject to any disclaimer, the term of this patent is extended or adjusted under 35 U.S.C. 154(b) by 821 days.

(21) Appl. No.: 12/239,619

(22) Filed: Sep. 26, 2008

(65) Prior Publication Data

US 2009/0114106 A1 May 7, 2009

Related U.S. Application Data

(60) Provisional application No. 60/976,323, filed on Sep. 28, 2007.

(51) Int. Cl.
*B41F 17/00* (2006.01)

(52) U.S. Cl. ..... 101/44; 269/55

(58) Field of Classification Search ..... 101/44
See application file for complete search history.

(56) References Cited

U.S. PATENT DOCUMENTS

| | | | | |
|---|---|---|---|---|
| 1,352,528 | A | 9/1920 | Radimak | |
| 2,396,941 | A * | 3/1946 | Corrigan et al. | 269/57 |
| 3,247,787 | A * | 4/1966 | Ryckman | 101/44 |
| 3,700,228 | A * | 10/1972 | Peale | 269/57 |
| 3,783,821 | A * | 1/1974 | Dobson et al. | 269/57 |
| 3,868,902 | A * | 3/1975 | Bradshaw et al. | 101/44 |
| 4,019,436 | A | 4/1977 | Handweiler et al. | |
| 4,557,195 | A | 12/1985 | Phlipp | |
| 4,615,266 | A | 10/1986 | DeRoche et al. | |
| 4,683,821 | A | 8/1987 | Berberich | |
| 4,723,485 | A * | 2/1988 | Berberich et al. | 101/44 |
| 4,738,199 | A | 4/1988 | Chen | |
| 4,905,594 | A | 3/1990 | Phillip et al. | |
| 5,003,872 | A | 4/1991 | Dalferth | |
| 5,052,293 | A | 10/1991 | Berberich | |

(Continued)

FOREIGN PATENT DOCUMENTS

EP 659556 A1 6/1995

(Continued)

OTHER PUBLICATIONS

International Search Report for Application No. PCT/US2008/78181.

(Continued)

*Primary Examiner* — Jill Culler
(74) *Attorney, Agent, or Firm* — Kolisch Hartwell, PC

(57) ABSTRACT

In one embodiment, a pad printing system configured to print a work piece having at least a first print area and a second print area distal from the first print area is provided. The pad printing system may include a first print station and a second print station, wherein each print station is independently operable and configured to transfer a fluid image from an ink tampon to a work piece at least once during a printing cycle. The pad printing system may further include a moveable platform and a work piece holder supported by the platform having a first orientation and a second orientation. The first orientation may be configured to align the first print area with an ink tampon in the first print station and the second orientation may be configured to align the second print area with an ink tampon in the second print station.

18 Claims, 3 Drawing Sheets

U.S. PATENT DOCUMENTS

| | | | | |
|---|---|---|---|---|
| 5,272,973 | A | 12/1993 | Chojnacki | |
| 5,320,037 | A | 6/1994 | Harris | |
| 5,383,398 | A | 1/1995 | Binnen | |
| 5,476,040 | A | 12/1995 | Kleist | |
| 5,503,583 | A * | 4/1996 | Hippely et al. | 446/14 |
| 5,537,921 | A | 7/1996 | Adner et al. | |
| 5,662,041 | A | 9/1997 | Kleist | |
| 5,664,496 | A | 9/1997 | Scheuhing et al. | |
| 5,694,847 | A | 12/1997 | Kleist | |
| 5,802,972 | A | 9/1998 | Hoffmann et al. | |
| 5,921,177 | A | 7/1999 | Shin | |
| 6,123,021 | A | 9/2000 | Cameron | |
| 6,244,172 | B1 | 6/2001 | Holmberg et al. | |
| 6,276,266 | B1 * | 8/2001 | Dietz et al. | 101/41 |
| 6,393,981 | B1 | 5/2002 | Cameron | |
| 6,418,843 | B1 * | 7/2002 | Givler | 101/35 |
| 6,516,716 | B1 | 2/2003 | Robertson et al. | |
| 6,918,337 | B2 | 7/2005 | Holmberg et al. | |
| 6,923,115 | B1 | 8/2005 | Litscher et al. | |
| 7,063,012 | B2 | 6/2006 | Tollhupp | |
| 7,089,860 | B2 | 8/2006 | Harris et al. | |
| 2004/0044430 | A1 | 3/2004 | Gillen | |
| 2006/0065137 | A1 * | 3/2006 | Nguyen et al. | 101/35 |
| 2006/0237889 | A1 | 10/2006 | Vosoughkia | |

FOREIGN PATENT DOCUMENTS

| | | | |
|---|---|---|---|
| JP | 08047585 | | 2/1996 |
| JP | 2004362540 | A | 12/2004 |
| WO | 9921718 | A1 | 5/1999 |

OTHER PUBLICATIONS

Written Opinion of the International Searching Authority for Application No. PCT/US2008/78181.

International Preliminary Examination Report from related Application No. PCT/US2008/78181, dated Apr. 8, 2010.

* cited by examiner

TAMPON PAD PRINTING SYSTEM AND METHOD OF OPERATING

RELATED APPLICATIONS

This application claims the benefit under 35 U.S.C. §119 (e) of U.S. Provisional Application No. 60/976,323, filed Sep. 28, 2007, incorporated herein by reference in its entirety for all purposes.

BACKGROUND

The present disclosure relates generally to tampon pad printing systems, and more particularly to pad printing systems configured to print a work piece having at least a first print area and a second print area distal from the first print area in one or more colors.

Pad printing systems have proven very useful for printing textured or non-planar objects. The basic elements of a pad printing system may include a printing plate or cliché, a silicon rubber pad or ink tampon, inks, an ink cup, a cleaning mechanism, and a machine.

The basic process for pad printing may be described as follows: First, the ink cup is positioned above the printing plate, and an etched image on the printing plate is flooded with ink by the ink cup. The printing plate is then cleaned or wiped by a cleaning mechanism. The ink cup and printing plate then slide laterally apart, leaving only the image area of the printing plate exposed. A pad is then positioned directly over the printing plate, pressed onto it to pick up the applied ink, and lifted away. The pad is then pressed down onto a surface to be printed, conforming to its shape and depositing the ink in the desired location. The pad is then lifted away from the newly printed surface.

Examples of pad printing systems are discussed in more detail in U.S. Pat. Nos. 1,352,528, 4,019,436, 4,557,195, 4,615,266, 4,683,821, 4,905,594, 5,003,872, 5,052,293, 5,272,973, 5,320,037, 5,383,398, 5,476,040, 5,537,921, 5,662,041, 5,664,496, 5,694,847, 5,802,972, 5,921,177, 6,244,172, 6,393,981, 6,516,716, 6,923,115, 7,063,012, 7,089,860, WO9921718, EP659556, and JP2004362540. The disclosures of all of the patents, patent applications, and publications recited herein are incorporated herein by reference.

The advantages of the present disclosure will be understood more readily after a consideration of the drawings and the Detailed Description.

SUMMARY

The present disclosure is directed to pad printing systems that are configured to print a work piece having at least a first print area and a second print area distal from the first print area, and methods of using the same. The pad printing systems include a first print station and a second print station, a platform configured to move with respect to the first print station and the second print station, and a work piece holder supported by the platform.

Each print station can be operated independently and each print station is configured to transfer a fluid image from an ink tampon to a work piece at least once during a printing cycle.

The work piece holder has a first orientation and a second orientation, and is configured to move between the first orientation and the second orientation during the printing cycle. The first orientation is configured to align the first print area with an ink tampon in the first print station, and the second orientation is configured to align the second print area with an ink tampon in the second print station.

DETAILED DESCRIPTION

In one embodiment, the invention may include a pad printing system configured to print a work piece having at least a first print area and a second print area distal from the first print area is provided. The pad printing system may include a first print station and a second print station, wherein each print station is independently operable and configured to transfer a fluid image from an ink tampon to a work piece at least once during a printing cycle. The pad printing system may further include a platform configured to move with respect to the first print station and the second print station and a work piece holder supported by the platform having a first orientation and a second orientation. The work piece holder may be configured to move between the first orientation and the second orientation during the printing cycle. The first orientation may be configured to align the first print area with an ink tampon in the first print station and the second orientation may be configured to align the second print area with an ink tampon in the second print station.

In some embodiments, a multicolor pad printing system for printing a work piece having a first print area and a second print area distal from the first print area is provided. The pad printing system may include a first print station and a second print station linearly orientated with respect to the first print station. Each print station may be independently operable and may include a ink tampon carrier member. At least one ink tampon carrier member may include a plurality of ink tampons aligned next to one another.

The pad printing system may include a platform configured to incrementally move in a linear first direction adjacent the first and second print stations such that the platform is positionable with respect to each ink tampon and a work piece holder supported by the platform. The work piece holder may have a first orientation configured to align the first print area with an ink tampon of the first print station and a second orientation configured to align the second print area with an ink tampon of the second print station.

In some embodiments, a method of pad printing multiple colors on a work piece having a first print area and a second print area distal from the first print area, at a print system including two independently operable pad print stations each including one or more ink tampons and a work piece holder supported by a platform, is provided. The method of printing may include positioning the work piece in the work piece holder such that the first print area is aligned with an ink tampon and transferring at least one fluid image from the first pad print station to the first print area. The method may further include moving the work piece holder with respect to the platform such that the second print area is aligned with a ink tampon and transferring at least one fluid image from the second pad print station to the second print area.

Figure 1:
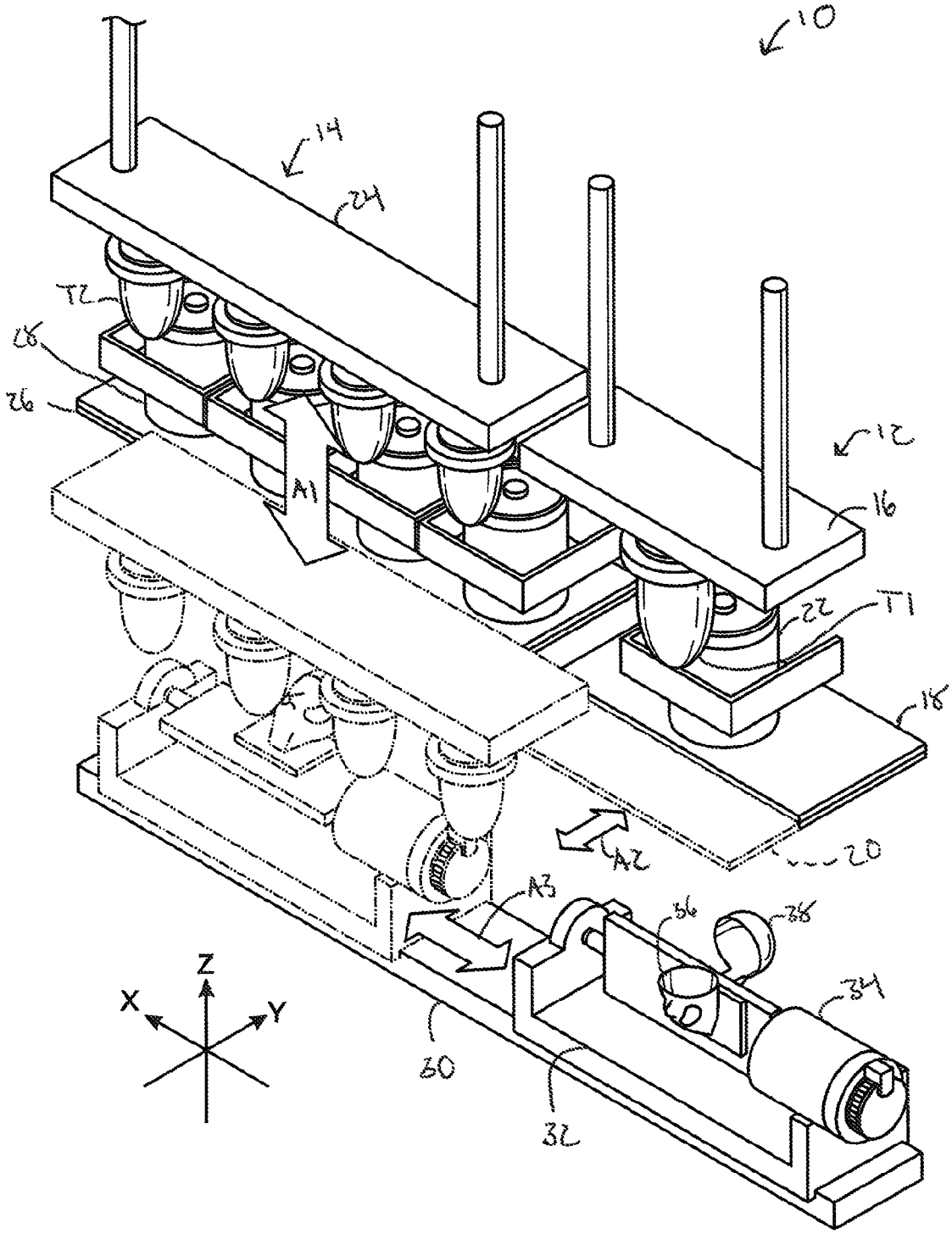
FIG. 1 is perspective view of an embodiment of a pad printing system according to the present invention, including a first and a second printing station.

FIG. 1 depicts a front perspective view of an exemplary pad printing system, indicated generally at 10, configured to print a work piece having at least a first print area and a second print area distal from the first print area in accordance with the present disclosure. Pad printing system 10 may print one or both of the print areas on the work piece in one or more colors in a printing cycle.

Pad printing system 10 may include a first print station 12 and a second print station 14, in linear alignment with the first print station 12. The first print station 12 may include a first pad carrier member 16 configured to support one or more ink tampons T1, and a first plate support member 18 including one or more printing plates 20 and inking devices 22. The second print station 14 may include a second pad carrier member 24 configured to support one or more ink tampons T2, and a second plate support member 26 including one or more printing plates and inking devices 28. Each print station may be independently operable. In other words, each print station may move and operate independent of the movement and operation of the other print station.

In accordance with the present disclosure, the movement of a pad carrier member, an inking device, and a plate support member to transfer ink from the inking device to an ink tampon may occur according to any of the references incorporated by reference above. However, in some embodiments, one or both pad carrier members may be configured for reciprocal movement along the Z axis, as indicated by directional arrow A1, and/or one or more printing plates may be configured for reciprocal movement along the Y axis, as indicated by directional arrow A2.

Pad printing system 10 may include a rail 30 aligned with the first pad carrier member 16 and the second pad carrier member 24 along the X axis, and spaced from the first pad carrier member 16 and the second pad carrier member 24 along the Z axis. A platform 32 may be slidingly mounted on the rail. The platform may be configured for reciprocal movement on the rail along the X axis, as indicated by directional arrow A3.

Movement of the platform 32 on the rail 30 may be incremental or continuous. For example, the platform 32 may move incrementally on the rail such that it is sequentially aligned with each ink tampon supported by a pad carrier member. Additionally and/or alternatively, the platform 32 may move such that it is aligned with fewer than each ink tampon in a printing cycle or may transverse all printing stations, for example to return to an initial position after a printing cycle.

Figure 2:
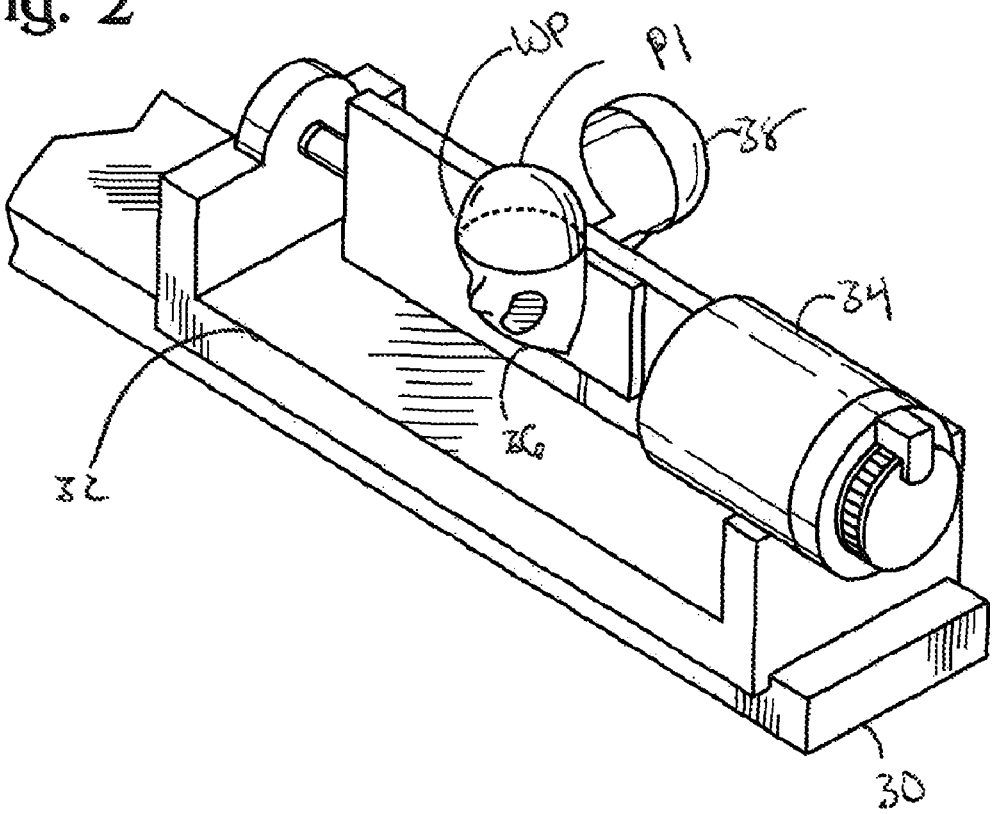
FIG. 2 is a perspective view of a work piece holder and a work piece in a first orientation according to an embodiment of the present invention.
Figure 3:
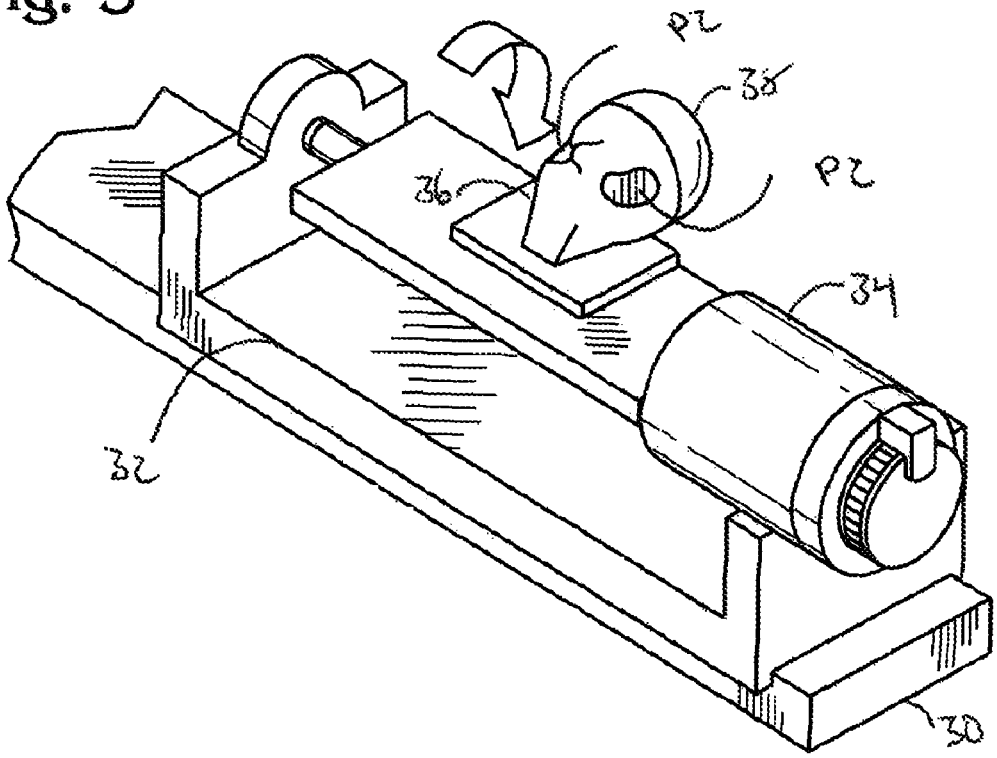
FIG. 3 is a perspective view of the work piece holder of FIG. 2 in a second orientation according to an embodiment of the present invention.

Turning to FIGS. 2-3, an exemplary work piece WP is depicted as a doll's head including a first print area P1, generally the crown of the doll's head, and a second print area P2 distal from the first print area, generally the cheeks of the doll's head. The doll's head, however, is a non-limiting example of a work piece and/or a first print area and a second print area. A work piece in accordance with the present disclosure may include any work piece having at least a first print area and a second print area. Additionally, a print area may include one or more parts of a work piece, such as lips, eyes and/or ears, and the like.

As illustrated in FIGS. 1-3, a work piece holder 34 configured to removably retain at least one work piece may be supported by the platform. The work piece holder 34 may include a first orientation, shown in FIG. 2, and a second orientation, shown in FIG. 3, and may be configured to move from the first orientation to the second orientation in a printing cycle. The first orientation may align the first print area P1 with an ink tampon and the second orientation may align the second print area P2 with an ink tampon.

The work piece holder 34 may include a first member 36 and a second member 38. One or both the first member 36 and the second member 38 may be sized and shaped to releasably retain the work piece WP and further selectively cover non print areas of the work piece WP. For example, the first member 36 may conform to the shape of a doll's face except for the second print area P2, which is left exposed such that it may be printed and/or printed ink may dry. The second member 38 may conform to the back of the doll's head. In some embodiments, the second member 38 may be configured to expose the first print area P1 such that it may be printed and/or printed ink may dry.

One or both the first member 36 and the second member 38 may be rotatable for transition from the first orientation and the second orientation during a printing cycle. For example, as shown in FIG. 2, in the first orientation, the first member 36 and the second member 38 may be spaced from one another. The work piece WP may be removably retained by the first member 36 only. As shown in FIG. 3, the first member 36 may be configured to rotatably align adjacent the second member 38 in the second orientation, such that the work piece WP is removably retained by the first member 36 and the second member 38.

The work piece holder 34 may be in the first orientation when adjacent the first printing station, and in the second orientation when adjacent the second printing station. Therefore, two or more areas of the work piece WP may be printed in printing cycle. Additionally and/or alternatively, the work piece holder 34 may incrementally move or rotate from the first orientation to the second orientation as the platform 32 slides on the rail 30. In some embodiments, the work piece holder 34 may be configured to move or rotate to include more than two orientations. The more than two orientations may align more than two print areas with an ink tampon.

Figure 4:
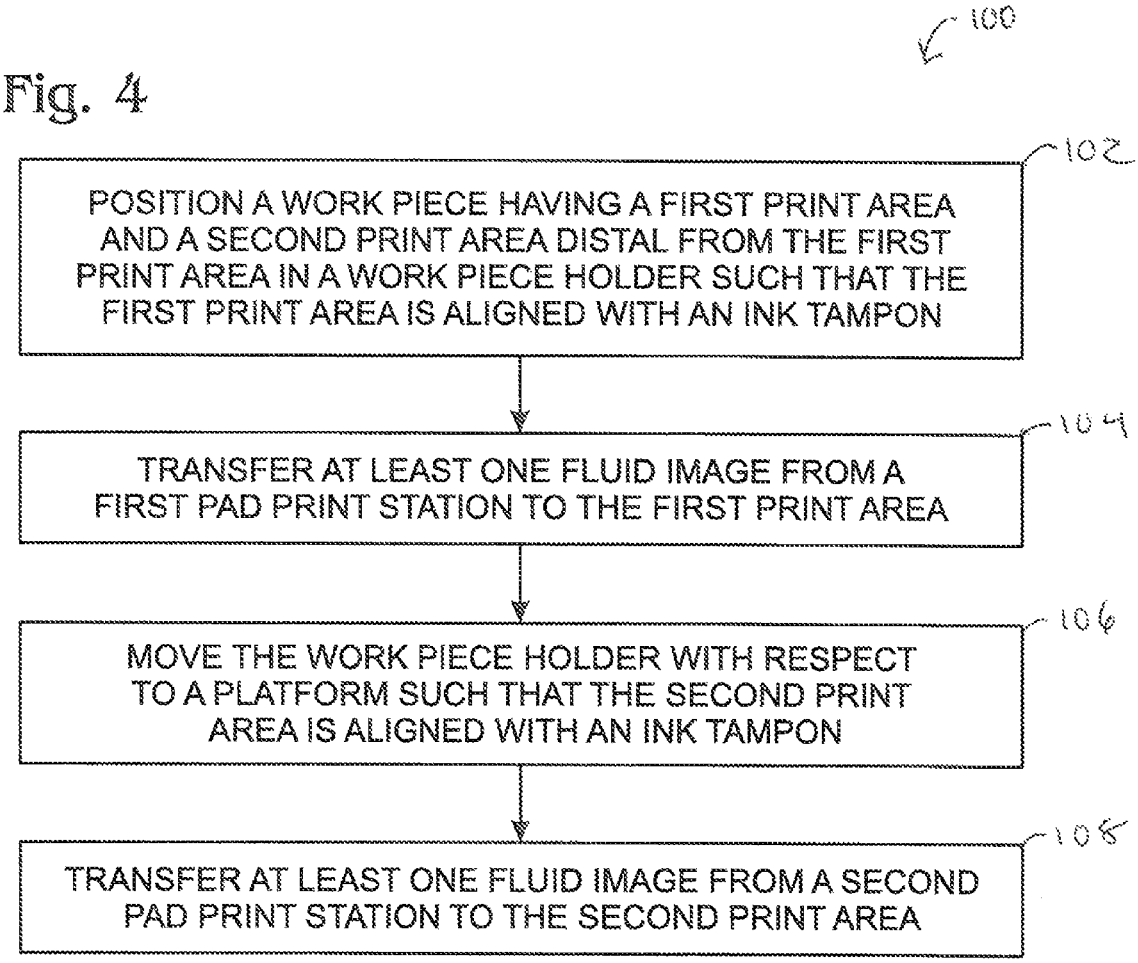
FIG. 4 is a flowchart depicting a method of pad printing a work piece, according to an embodiment of the present invention.

Turning now to FIG. 4, an exemplary method, indicated generally at 100, of pad printing a work piece including a first print area and a second print area, distal from the first print area, may include positioning a work piece in a work piece holder supported by a platform such that the first print area is aligned with an ink tampon 102. At least one fluid image may then be transferred from a first print station to the first print area 104. The work piece holder may then be moved with respect to the platform such that a second print area is aligned with an ink tampon 106. At least one fluid image from a second pad print station may then be transferred to the second print area 108.

Some embodiments may include an initial or starting position, in which a sliding platform including a work piece holder may be positioned on a rail adjacent a first printing station. The work piece holder, including a first member and a second member, may be in a first orientation in which the first member and the second member are spaced from one another. In the starting position, an operator may removably position a doll's head on the first member. The first print station may then transfer ink from a printing plate to the crown of the doll's head according to any of the methods disclosed in the references incorporated above.

For example, the sliding platform and the work piece holder may be initially disposed below a first pad carrier member. A first printing plate slides out such that it is disposed between the work piece holder and the first pad carrier member. The first pad carrier member lowers to receive ink from the first printing plate and then rises to permit the first printing plate to retract. The first pad carrier member then lowers and rises to deposit ink on the crown of the first doll's head.

After printing by the first print station, the first member of the work piece holder may rotate to a second position or orientation. In the second position, the first member and the second member of the work piece holder may be adjacent one another such that the first member and the second member removably retain the doll's head. In the second position, a second print area may be exposed, for example the lip and cheek area of the doll's head.

The sliding platform may then slide along the rail such that it is adjacent a second print station. A second printing plate may slide out such that it is disposed between the work piece holder and the second pad carrier member. The second pad carrier member may lower to receive ink from the second printing plate and then rise to permit the second printing plate to retract.

The second pad carrier member may then lower and rise as the sliding platform incrementally slides along the rail, such that the lip and cheek of the doll's head may receive ink from each of a set of ink tampons secured to the second pad carrier member.

After receiving ink from the second printing station, the sliding platform may then return to its initial or start position. The work piece holder may return to the first, or open, position. The printed doll's head may still be removably retained by the second member of the work piece holder. The operator may remove the printed doll's head from the second member and position a new doll's head in the first member to start a new printing cycle.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A pad printing system configured to print a work piece having at least a first print area and a second print area distal from the first print area, comprising:

a first print station and a second print station, wherein each print station is independently operable and configured to transfer a fluid image from an ink tampon to a work piece at least once during a printing cycle;

a platform configured to move with respect to the first print station and the second print station; and a work piece holder supported by the platform having a first orientation with respect to the platform and a second orientation with respect to the platform, wherein the work piece holder is configured to move between the first orientation and the second orientation during the printing cycle and the first orientation is configured to align the first print area with an ink tampon in the first print station and the second orientation is configured to align the second print area with an ink tampon in the second print station;

wherein a portion of the work piece holder covers the first print area of the work piece in the second orientation.

2. The system of claim 1, further comprising a rail adjacent the first and second print stations, wherein the platform is slidably mounted to the rail.

3. The system of claim 1, wherein the work piece holder includes a first member rotatably associated with a second member such that in the first orientation the first member is spaced from the second member and in the second orientation the first member is adjacent the second member.

4. The system of claim 1, wherein the work piece includes a doll's head and in at least one of the first orientation or the second orientation the crown of the doll's head is aligned with an ink tampon in a print station.

5. The system of claim 1, wherein at least one of the first and second print stations includes a plurality of ink tampons and is configured to transfer a fluid image from each ink tampon to a work piece during a print cycle.

6. A multicolor pad printing system for printing a work piece having a first print area and a second print area distal from the first print area, comprising:

a first print station and a second print station linearly orientated with respect to the first print station, each print station independently operable and including a ink tampon carrier member, wherein at least one ink tampon carrier member includes a plurality of ink tampons aligned next to one another;

a platform configured to incrementally move in a linear first direction adjacent the first and second print stations such that the platform is positionable with respect to each ink tampon; and a work piece holder supported by the platform having a first orientation with respect to the platform configured to align the first print area with an ink tampon of the first print station and a second orientation with respect to the platform configured to align the second print area with an ink tampon of the second print station;

wherein the work piece holder is configured to cover the first print area of the work piece in the second orientation.

7. The system of claim 6, further comprising a rail adjacent the first and second print stations, wherein the platform is slidably mounted to the rail.

8. The system of claim 6, wherein the work piece holder includes a first member rotatably associated with a second member such that in the first orientation the first member is spaced from the second member and in the second orientation the first member is adjacent the second member.

9. The system of claim 6, wherein the work piece holder includes a first member and a second member and in the first orientation the first member removably retains the work piece and in the second orientation the first member and the second member removably retain the work piece.

10. A method of pad printing multiple colors on a work piece having a first print area and a second print area distal from the first print area, at a print system including two independently operable pad print stations each including one or more ink tampons and a work piece holder supported by a platform, comprising:

positioning the work piece in the work piece holder such that the first print area is aligned with a ink tampon;

transferring at least one fluid image from the first pad print station to the first print area;

moving the work piece holder with respect to the platform such that the second print area is aligned with a ink tampon;

wherein a portion of the work piece holder covers the first print area of the work piece after said movement; and transferring at least one fluid image from the second pad print station to the second print area.

11. The method of claim 10, further comprising sequentially moving the platform in a linear first direction during successive transfer from each of the pad print stations to the work piece.

12. The method of claim 10, wherein at least one of the first and second print stations includes more than one ink tampon, further comprising sequentially transferring at least one fluid image from each ink tampon to the first or second print area.

13. The method of claim 12, further comprising sequentially moving the platform in a linear first direction during successive transfer from each ink tampon to the work piece.

14. The method of claim 13, further comprising moving the platform in a second direction opposition the first direction after transfer from each ink tampon.

15. The method of claim 10, wherein the work piece is a doll's head.

16. The method of claim 15, wherein one of the first print area and the second print area includes the crown of the doll's head.

17. The method of claim 15, wherein one of the first print area and the second print area includes the cheek area of the doll's head.

18. The method of claim 10, further comprising removing a printed work piece from the work piece holder.

* * * * *